US006792695B2

(12) United States Patent
Fry et al.

(10) Patent No.: US 6,792,695 B2
(45) Date of Patent: Sep. 21, 2004

(54) FABRIC TREATMENT DEVICE

(75) Inventors: Alan John Fry, Ellesmere Port (GB); Uwe Hagemann, Wirral (GB); Steven Hayes Hayes, Wirral (GB); Colin Watt Kerr, Wirral (GB)

(73) Assignee: Unilever Home & Personal Care USA, divison of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/414,903

(22) Filed: Apr. 16, 2003

(65) Prior Publication Data

US 2003/0200674 A1 Oct. 30, 2003

(30) Foreign Application Priority Data

Apr. 16, 2002 (GB) ..... 0208697

(51) Int. Cl.[7] ..... F26B 11/02

(52) U.S. Cl. ..... 34/597; 34/595; 222/325; 222/485

(58) Field of Search ..... 34/597, 595, 131; 222/325, 361, 485, 52

(56) References Cited

U.S. PATENT DOCUMENTS 3,634,947 A 1/1972 Furgal ..... 34/60
3,701,202 A * 10/1972 Compa et al. ..... 34/72
4,379,515 A * 4/1983 Towsend ..... 222/52
4,642,908 A 2/1987 Brenner ..... 34/60
5,072,526 A * 12/1991 Hirota et al. ..... 34/60
5,176,297 A * 1/1993 Mooney et al. ..... 222/325
5,675,911 A * 10/1997 Moser ..... 34/389

FOREIGN PATENT DOCUMENTS

| | | |
|---|---|---|
| CA | 1 005 204 | 2/1977 |
| EP | 361 593 | 4/1990 |
| GB | 1 399 728 | 7/1975 |
| GB | 1 546 763 | 5/1979 |
| GB | 2 066 309 | 7/1981 |
| GB | 2 231 944 | 11/1990 |
| WO | 02/33161 | 4/2002 |

* cited by examiner

*Primary Examiner*—Ira S. Lazarus
*Assistant Examiner*—Kathryn S. O'Malley
(74) *Attorney, Agent, or Firm*—Kevin J. Stein

(57) ABSTRACT

The invention provides a device for treating fabrics in a tumble dryer comprising: a reservoir for storing a fabric treatment composition and transfer means to expose fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle; characterised in that the transfer means comprises at least an inner flow control member and an outer flow control member arranged in series, wherein the flow control characteristic of the inner flow control member is greater than that of the outer flow control member.

23 Claims, 4 Drawing Sheets

FABRIC TREATMENT DEVICE

Figure 1:
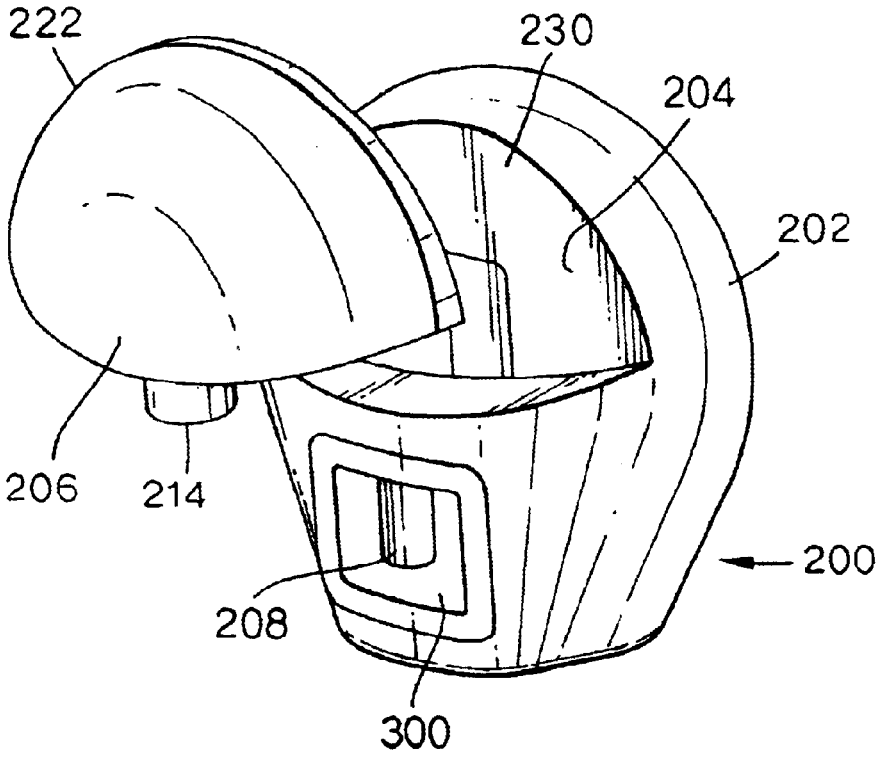
Figure 2A:
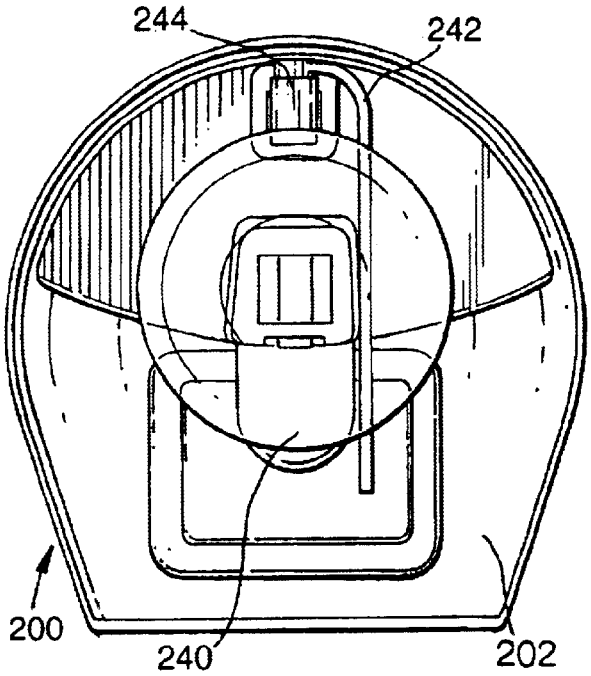
Figure 2B:
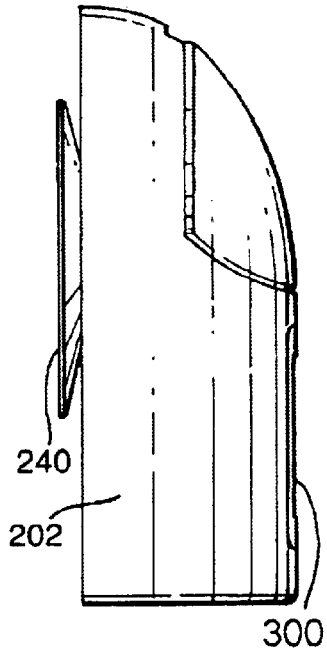
Figure 2C:
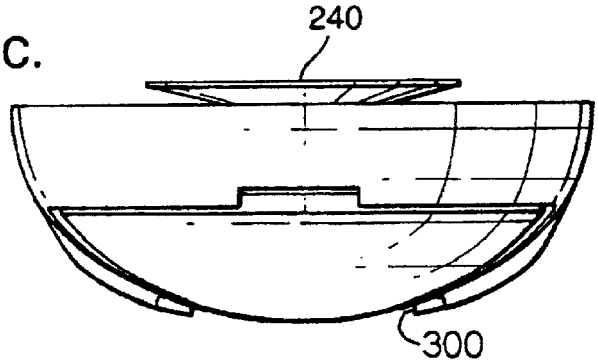
Figure 2D:
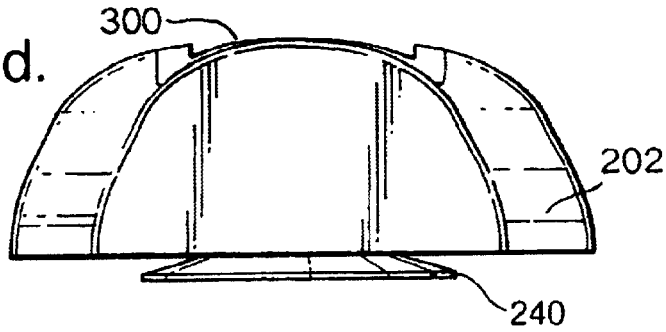
Figure 3A:
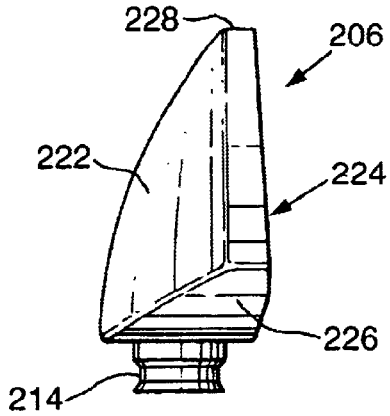
Figure 3B:
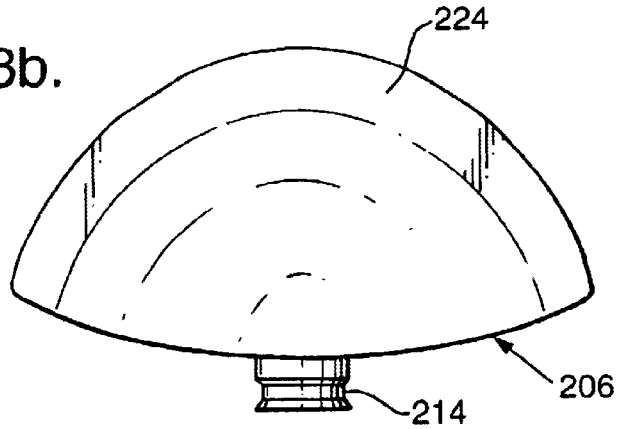
Figure 3C:
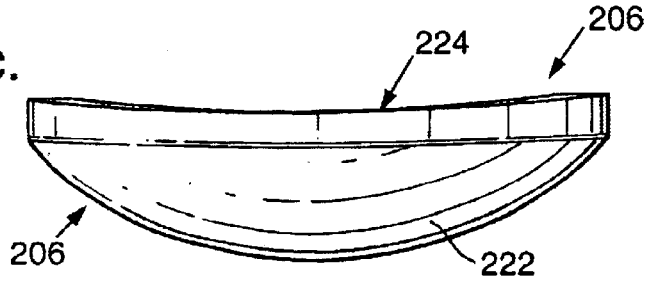
Figure 3D:
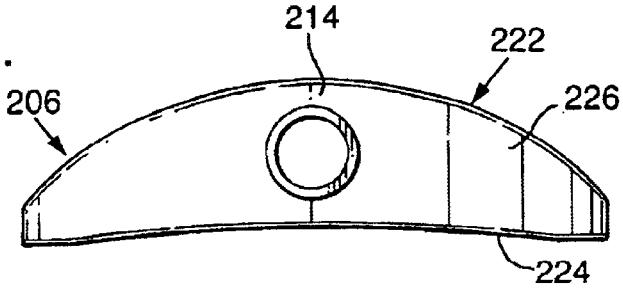
Figure 3E:
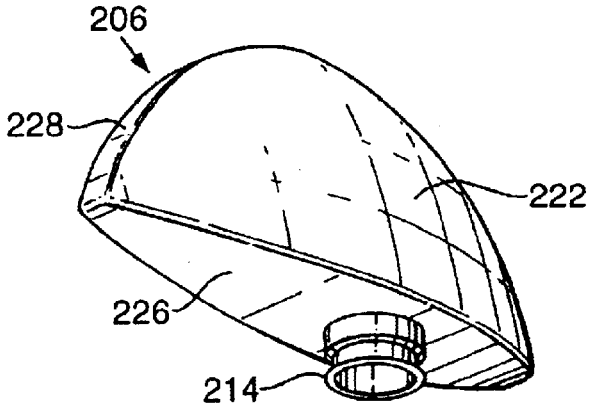
Figure 3F:
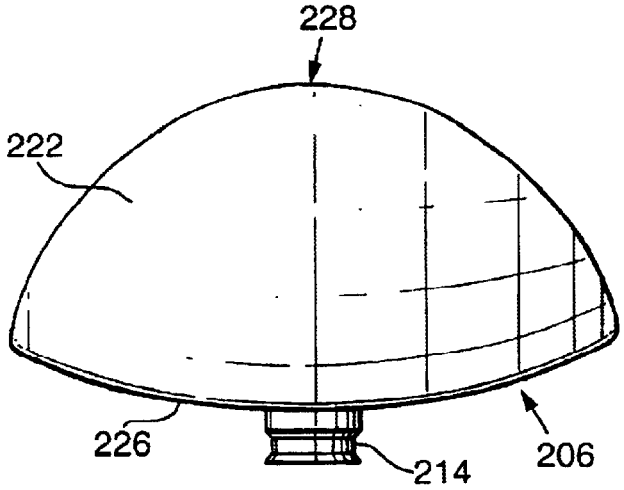
Figure 3G:
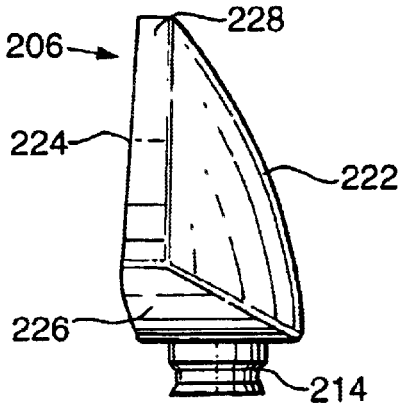

The present invention relates to a device for treating, fabrics inside a tumble dryer, particularly a device which is reusable.

In the treatment of fabrics in a tumble dryer it is known to add one or more conditioning agents. For instance, for imparting a softening benefit to fabrics it is known from CA 1,005,204 to co-mingle fabrics in a tumble dryer with a flexible substrate carrying a normally solid fabric conditioning agent. The co-mingling of the fabrics with impregnated substrates requires the separation of the substrate from the fabrics after the completion of the tumble dryer treatment. Especially in using flexible substrates, this separation is often time-consuming in that the substrates cannot readily be located. Other disadvantages of such products include uneven product distribution following entanglement of the substrate with fabrics which can lead to greasy marks on fabrics (staining) and the tendency of such substrates to become positioned over the tumble dryer vent, thus giving virtually no benefit to the fabrics during a tumble drying cycle. Furthermore, these products are designed for single use only and therefore need to be replaced after every cycle.

For overcoming these problems it has been suggested, for instance in GB 2,066,309 and U.S. Pat. No. 3,634,947, to use conditioner dispensing articles, comprising means for attachment of the substrate to the tumble dryer wall. Other proposals, such as for instance disclosed in GB 1,399,728 involve the use of separate means for attaching the conditioning article to the tumble dryer wall.

EP-B-361593 concerns an alternative approach in which a fabric conditioning article comprises a combination of a substrate and a fabric conditioning composition, the substrate being a porous material with a specified void volume and cell count. The article of EP-B-361593 is designed to adhere to the tumble dryer wall.

It is an object of the present invention to provide an improved device suitable for treatment fabrics in a tumble dryer. It is also an object to provide a device capable of efficient and accurate dosing of the fabric treatment composition.

According to the present invention, there is provided a device for treating fabrics in a tumble dryer comprising: a reservoir for storing a fabric treatment composition and transfer means to expose fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle; characterised in that the transfer means comprises two or more flow control members arranged in series, wherein the flow control characteristic of the members decreases across the series.

The flow control characteristic preferably decreases in the direction of flow across the transfer means.

The flow control characteristic may decrease progressively across the series, i.e., it decreases with each flow control member, or there may be static regions of the transfer means, whereby the flow control characteristic remains unchanged across adjacent members, or even increases across members within the series. However, preferably, there should be an overall decrease in the flow control characteristic across the series.

In a second aspect of the invention there is provided a device for treating fabrics in a tumble dryer comprising: a reservoir for storing a fabric treatment composition and transfer means to expose fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle; characterised in that the transfer means comprises at least an inner flow control member and an outer flow control member arranged in series, wherein the flow control characteristic of the inner flow control member is greater than that of the outer flow control member.

As used herein, the term "flow control characteristic" is intended to refer to any property which represents/brings about the impedance/control of the flow of fabric treatment composition passing through the member.

Decreasing the flow control characteristic across the series may involve selecting relative pore sizes of the respective members (e.g. an inner member having a higher flow control characteristic i.e. smaller pore size as compared an outer member having a lower characteristic (larger pore size.). Other features may be selected additionally or alternatively to the pore size so as to control the flow, e.g. member thickness.

As used herein, the terms "transfer means" and "flow control member", should be construed as including any structure(s) acting to actively or passively allow the flow of fabric treatment composition thereacross whereby the composition from the reservoir can be exposed to the air in the dryer or to directly contact fabrics in the dryer.

With this arrangement, precise flow control and thereby precise dosing of fabric treatment composition may be effected by an inner flow control member(s) which is/are protected by an outer flow control member(s) which is/are less precise but may therefore be more robust so providing a barrier(s) or shield(s) for the inner member(s). Delicate but precise materials may be used for the inner member(s) but it/they is/are not subjected to mechanical damage by tumbling fabrics, zips, buttons etc during a tumble dry cycle because of the protection afforded by the outer member(s).

The outer flow control member or members may be of greater rigidity than the inner flow control member(s). In this way, the outer members are not deflected to the extent that they impinge on the inner membrane, as this could interfere with the precise flow control of the inner control member.

Preferably, the flow control member(s) are spaced apart to define a gap therebetween, whilst being in fluid communication with each other and the reservoir. With this arrangement, any flexing of an outer member (e.g. in response to contact by fabrics, zips, buttons etc) can be isolated from the inner member, which is thereby protected. Thus, any potential consequential interference in precise flow control exerted by an inner membrane is prevented.

Preferably the most delicate flow control member (e.g. the innermost) is spaced apart from the other flow control members (which may not necessarily be spaced apart as they may not require protection).

The transfer means may be a dedicated component of the body or may form part of the device body and/or reservoir which may be a optionally integral.

The inner flow control member(s) may, for example, comprise a membrane, or a layer of e.g. semi permeable material/s e.g. polyester, polypropylene or the like or a woven/non-woven membrane which may be, but is not intended to be restricted to a thin skin.

The transfer means may be fixed in position around its perimeter and preferably has an effective area of 500–2500 mm.

The reservoir may be removable from a housing or body portion locating the transfer means which is in fluid connection with the reservoir (when installed). Such fluid connection may be effected by a connecting channel or duct.

The fluid connection preferably includes an inlet port or channel for receiving a predetermined amount of the composition from the reservoir sufficient for a predetermined number of cycles at a given temperature, time and load size and may further include a charging port or channel or recess situated directly behind the membrane for continuous feed or charging of the flow control members.

In further embodiments of the invention, the flow control members may include a multiplicity of very small openings or pores. The inner member(s) may include a precise but delicate or mechancially weak structure as compared with the outer flow control member(s). Accordingly the inner member(s) may comprise a semi-permeable membrane through which the fabric composition can be precisely dosed to the fabrics. Suitable semi-permeable materials may include Goretex™ and Accurel™. The outer flow control members may be formed from more rigid but less precise semi-permeable materials including open cell pumice, sintered materials etc.

The transfer of fabric treatment composition to the fabrics in the tumble drier may be effected solely by airflow generated in the tumble drier. Depending upon the model of the tumble drier and program setting temperatures of us to 100° C. with wet clothes may be generated within the tumble drier, generally in the range 30° C. to 80° C. for most drying cycle (the hot air generated bay the heater in the tumble drier may be as high as 150° C., generally 110° C. to 120° C.).

In addition, the transfer may be constructed and arranged such that there may be direct contact between fabric in the tumble drier and the exposed fabric treatment composition in order to facilitate transfer of fabric treatment composition to the fabric.

Accordingly, the external profile of the flow control member(s) and/or that part/surface of the device in which the member(s) are located, may be shaped so that in use (i.e. attached to a generally upright tumble dryer wall or door) it/they are generally upright.

With this configuration, the Applicants have found that the member/part/surface can more easily contact the fabrics in the dryer directly contact fabrics in the dryer, thereby transferring a portion of the fabric treatment composition into contact with fabrics in the tumble dryer during a tumble drying cycle.

The device may be configured to present a smooth external profile when attached to a door or wall. This feature has the advantage that it prevents or at least can reduce the possibility of the device damaging the fabrics as they move through the dryer. It may not be important that the attachment part of the device is smooth, if this is not exposed when the device is fixed in place. In one embodiment the external profile is generally; hemispherical, and optionally including an upright (in use) portion as described above.

The reservoir may hold sufficient fabric composition for any number of drying cycles and for instance the reservoir may hold sufficient composition for a single cycle. With this arrangement, different compositions could be used for different drying cycles allowing great flexibility for the user.

The reservoir of the device of the invention may alternatively or additionally be capable of holding sufficient fabric treatment composition for a plurality of drying cycles of the tumble drier. In this case, the reservoir preferably holds sufficient composition for at least six, preferably at least ten drying cycles, more preferably at least twenty cycles, of the tumble drier. The device may comprise means for dispensing a unit dose of fabric composition from the reservoir at or before the start of the drying cycle which is sufficient to provide the required amount of fabric treatment composition during the drying cycle. The reservoir may be divided into a plurality of cavities or compartments each containing fabric composition, the contents of each cavity may be sequentially transferred to the transfer means.

The means for indicating to the user when the fabric treatment composition is used up preferably comprises visible indicia associated with the device. In one embodiment of the invention, the user is able simply to inspect the quantity of fabric treatment composition remaining in the device by looking through the at least one opening of the reservoir to the composition therein. Alternatively, the fabric treatment composition may be impregnated in a solid substrate which gives an appearance change, for example changes colour, when all the fabric treatment composition has been used up. In another embodiment of the invention, the reservoir may be formed from a transparent or translucent material to allow visual inspection of the quantity of fabric treatment composition inside the reservoir.

The device of the invention may further comprise a flow controller to allow the user to regulate the quantity of fabric treatment composition contacted by the warm air in the tumble dryer during a tumble drying cycle.

Preferably the device can be used to treat fabrics during multiple tumble drying cycles. With this arrangement, the dispenser may be more convenient as the user only need replenish the fabric treatment composition after a number of cycles.

The device of the invention preferably comprises means for indicating to the user when the fabric treatment composition is used up, which has the advantage of enabling the user to determine when the fabric treatment composition or the device itself needs replacing. A further advantage of attachment of the device to the tumble dryer door is that it makes it easier to replace or refill the device when the fabric treatment composition is used up than is the case with prior art devices attached to the tumble dryer drum.

The device according to the invention may comprise a reservoir which is designed to be replaced when the fabric treatment composition is used up. For example, the reservoir may be provided in the form of a disposable plastic container e.g. bottle, carton or collapsible pouch which may have a peelable lid.

Alternatively, the reservoir may be designed to be recharged with a new fabric treatment composition when required. In this case the reservoir has an openable portion for charging and, if necessary, discharging the fabric treatment composition. For example, the reservoir may be provided in the form of an openable compartment into which may be placed a block or semi-permeable sachet of fabric treatment composition. Suitable materials for the reservoir include polypropylene.

Preferably, the device has attachment means for attaching the device to the inside of the tumble dryer door. The provision of attachment means has a number of advantages over prior art devices. It is easier for a user to affix a device to the inside of the tumble dryer door, which swings open to face the user during loading and unloading of the tumble dryer, than it is to affix a device inside the tumble dryer drum as is the case with prior art devices. Once affixed to the inside of the tumble dryer door the device of the invention is clearly visible to the user during loading and unloading of the tumble dryer.

The means for attaching the device to the inside of the tumble dryer door may comprise adhesive means, for example in the form of an adhesive pad situated on one surface of the reservoir. Alternatively, suction means may be used in the form of, for example, a suction pad. Other suitable attachment means include hooks, claws and Velcro™. It may be desirable to provide more than one different type of attachment means on the device for versatility in different tumble dryer environments. For example a sucker form of attachment would be suitable for attaching the device to the glass/plastic/metal door of a conventional tumble dryer (usually with an external vent). However, many modern tumble dryers have a number of small holes in the inside of the door to allow moisture out of the tumble dryer drum to condense in a tray below or vented to the outside of the machine. In this case, a hook or claw attachment on the device may be more suitable. However, it is not always the case that condenser machines require a hook-type faster and vented machines require a sucker. Some condenser machines are configured such that a sucker works better, and vice versa.

There are other ways of attaching the device to the door, e.g. by a magnet, by a bayonet clip, by glue, by extendable arms which may have a raw plug configuration. The device may include a mounting bracket/frame for attachment to the dryer door, to which the device body is then attached.

The fabric treatment composition may be in the form of a liquid, solid or gel. The composition preferably comprises at least a perfume component and optionally water and may also comprise one or more perfume solubilisers. In this way the composition can act as a freshening composition.

In addition, according to a further aspect of the invention there is provided a kit for the treatment of fabrics in a tumble drying cycle, comprising the combination of the device of the first or second aspect of the invention, together with a fabric treatment composition which may contained in a reservoir suitable for use with said device. Instructions for use of the device, including installation/refilling of said reservoir may be included.

In addition, according to the invention there is provided a method of treating fabrics in a tumble dryer during multiple tumble drying cycles comprising attaching a device according to the invention to the inside of a tumble dryer door and carrying out a tumble drying process with fabrics inside the tumble dryer.

Further provided in accordance with the invention is a tumble dryer with a device according to the invention attached therein.

For the avoidance of doubt optional/preferred features of the first aspect of the invention may also be features of the second aspect and vice versa.

Various non-limiting embodiments of the invention will now be more particularly described with reference to the following figures in which:

FIG. 1 is a schematic Perspective view of a first embodiment according to one aspect of the invention;

FIGS. 2*a*–2*d* are further views of the device of FIG. 1.

FIGS. 3*a*–3*g* are different views of a reservoir according to one aspect of the invention.

FIG. 1 illustrates device 200 (shown orientated upright and viewed from the front) comprising a generally rigid dome shaped body 202 with a reservoir recess 204 configured for snap-fit receipt of a removable reservoir 206. The reservoir recess 204 constitutes a major part of the upper half of the body (when orientated upright).

The device 200 also includes a chamber or inlet port 208, having a capacity to hold a predetermined volume of fluid freshener, which is, in this embodiment 1.5 ml and is sufficient for one drying cycle of 1 hour at 60 degrees C. However, the inlet port may have a volume sufficient for any number of cycles. The port 208 is located beneath (when the device is held oriented as it would be when attached to the dryer door) and in fluid communication with the reservoir recess 204 to allow liquid to enter the port 208 from the reservoir 206 when it is in place in the recess 204.

As shown in FIGS. 3*a*–3*g*, the reservoir 206 comprises a polypropylene bottle with body portion and neck portion 214. The body portion is defined by three main generally crescent shaped faces: a front face 222 and a rear face 224 and a shoulder face 226. The front and rear faces 222, 224, extend from opposed edges of the shoulder face 226 and depend therefrom to meek at a common curved edge 228. The radius of curvature of the rear face 224 is less than that of the front face 222.

The reservoir recess 204, has a curved back wall 230, base wall 232 and top wall or lip 234 which correspond in shape with the rear face 222 shoulder face 226 and edge 228 respectively so that the reservoir is retained in the recess by the walls 230, 232 and 234 and by the retaining overhanging edges of 202 and by the engagement of the neck portion 214 with the port 208. The neck is configured for engagement with the inlet port 208, taking into account of any seals: The inlet port 208 may include an annular resilient seal 216 of a thermoplastic elastomer (TPE) to ensure leak proof engagement of the reservoir 206 with the port 208.

The reservoir preferably has a pin-hole (not shown) in the edge region 228 or front face 222 or back surface 224 so that as fluid freshener leaves the bottle it can be replaced with air, gradually, so as not to interfere with the gradual flow of the fluid to the membrane. This has the advantage of ensuring consistency in delivery of composition.

Insertion and removal is aided by limited flexibility of the refill bottle and device body such that snap-fit installation and removal can be effected even with the device attached to the dryer door, (attachment is explained below).

The rear of the device (shown at FIG. 2*a*) is recessed and contains a sucker 240 for attaching the (or even adjacent wall) of e.g. conventional dryers and a hook 242 for attachment to the tumble dryer door of e.g. condenser dryers (which have slots or holes in the door). One possible hook shape is shown (at 242) in FIG. 4*a* and comprises an elongate arm which is pivotable about a pivot 244 through about 90 degrees, between a position in which the hook 242 is enclosed within the rear recess and an attachment position in which it projects from the device. The hook is curved only where it connects with the device—it is straight at the opposite end, as the gentle curve blocks the removal of the machine filter in some machines, so needs to be removed from the design for such machines.

The device shown further includes a transfer means and is the general dome shape is modified by inclining the portion housing the transfer means outwardly, so that in use (i.e. attached to an upright tumble dryer door or wall) the transfer means is orientated upright.

The transfer means comprises two flow control members (not shown in detail but indicated at 300): an inner delicate but precise flow control member and an outer protective barrier or shield. The inner flow control member is a polypropylene membrane 210. In one embodiment this has with a thickness of 160 microns and a pore size of 0.2 microns. However other thickness/pore size values may be used, the appropriate pore size and thickness of the membrane varying depending on the fabric treatment composition viscosity, and the delivery rate required.

The outer membrane is a sinter material having a pore size of 35 micron, which is rigid as compared with the inner membrane and spaced apart therefrom. Flexing of the outer membrane is kept to a minimum due to its rigidity but if any flexing does occur (e.g. if more flexible material is used) the space between inner and outer members means the inner membrane is not contacted by the outer membrane as is flexes. This protects the inner membrane.

This members are fixed around their perimeters preferably by ultrasonic welds and preferably, to enable a better seal (for the purpose of preventing leaking of the fabric treatment composition), by a substantially continuous weld, to a window frame 212.

Optionally, the inlet port 208, is integral with the window frame, again, to enable a leak proof system. The manufacture of the framed membrane involves melting upstanding ribs on the frame by ultrasonic welding so as to weld these to the perimeter of the membrane. The framed membrane 210 is attached to the device body 202 (by the ultrasonic welding which is done with the port/frame/membrane in situ in the device body 202).

The area inside of the welded perimeter provides the effective flow control area that is to say the active part of the flow control members.

In the embodiments shown in FIGS. 1 and 2, the area is 40×27 mm=1080 $mm^2$. Another embodiments (not shown) may have has larder area of 50×27 mm=1350 $mm^2$, or larger still, Such as 80×30=2400 $mm^2$. Preferably the effective part of the transfer means has an area in the range 500–500 $mm^2$.

Behind the members is a recess of corresponding shape which has a slightly projecting perimeter region for attachment of the frame thereto, so that a gap is defined between the inner member and the recess wall. In this narrow gap approximately 2–3 mm, a small amount of freshener fluid can collect to 'charge' or 'feed' the members continuously without causing leakages.

It is important to prevent leakage of the fabric treatment composition, as this can lead to staining of fabrics.

In use the reservoir is disposed with the neck pointing downwards, engaging the inlet port so that fluid from the reservoir flows, under gravity to the port and then to the members from where it evaporates/transfers in the dryer.

The fabric treatment composition may take any suitable form, for example it may be as described in any of the following embodiments (e.g. solid, liquid, gel at room temperature).

Suitable Fabric Treatement Compositions may be as Follows:

A. A first fabric treatment composition, is defined as a heat activated fabric treatment composition comprising:

(a) from 3 to 75 wt % of one or more fabric treatment active ingredients;

(b) from 10 to 50 wt % of water;

(c) from 5 to 40 wt % of an oil; and (d) optionally from 2 to 20 wt % of a nonionic surfactant.

Samples of this composition are represented by a number. Comparative samples are represented by a letter.

All values are % by weight of the active ingredient unless stated otherwise.

The samples in table 1 were prepared as follows:

The quat, oil and optional solvent were weighed in a beaker and heated on a hot plate until molten (about 70° C.). Hot water (also about 70° C.) was then slowly dosed into the molten mixture with stirring. To this mixture, perfume was added and stirring continued until a 'clear' liquid was produced. The liquid was bottled and left to cool either in the bottle or on a rotary blender.

TABLE 1

| Sample | 1 | 2 | 3 | A | B | C |
|---|---|---|---|---|---|---|
| Quat (1)* | 50 | 50 | 50 | 80 | 50 | 50 |
| Sirius M85 (2) | 20 | 0 | 0 | 0 | 0 | 0 |
| NP-35 (3) | 0 | 20 | 0 | 0 | 0 | 0 |
| Estol 1545 (4) | 0 | 0 | 20 | 0 | 0 | 0 |
| DPG (5) | 5 | 5 | 5 | 10 | 0 | 5 |
| PEG 200 (6) | 0 | 0 | 0 | 0 | 25 | 0 |
| Glycerol | 0 | 0 | 0 | 0 | 0 | 20 |
| Perfume | 5 | 5 | 5 | 5 | 5 | 5 |
| Water | 20 | 20 | 20 | 5 | 20 | 20 |

(1) Stepantex VL85G (85%), tallow (IV about 35) based TEA quaternary ammonium material with 15% DPG solvent (ex Stepan)
(2) mineral oil, ex Fuchs
(3) mineral oil, ex Emca
(4) ester oil, ex Uniqema
(5) dipropylene glycol (ex Dow Chemicals). This was present in addition to any DPG present in the raw material of the quaternary ammonium material.
(6) polyethylene glycol 200, ex Clariant
For materials in table marked "*", the amount denotes the level of raw material present.

Staining Evaluation

Staining evaluation was then carried out on the fabrics identified in Table 2.

TABLE 2

| Garment | Fabric type | Colour | Texture |
|---|---|---|---|
| Single jersey | 100% acrylic | Multicolour | Knitted, thick |
| Sport trousers | 100% nylon | buff | Woven with woven nylon lining, light |
| Green shirt | 100% cotton | Green | Woven, light |
| Blue shirt | 100% Polyester | Blue | Woven peach skin (brushed), heavy |
| Fleece | 52% polyester 40% cotton 8% lastane | | Towel looped knit, heavy |
| Jeans trousers | 100% cotton | Blue | Denim |
| Cotton monitor | 100% cotton | Black | Woven, light |
| Microfibre monitor | 100% polyester | Pearly | Woven, light |
| Pongee monitor | 100% polyester | Pink | Tuffata, lining type |

A 1.5 kg load was washed in a Miele Novotronic W820 washing machine using 80 g of un-perfumed Persil fabric washing powder at a 40° C. wash temperature. The fabrics were spin dried and then transferred to a Miele Novotronic T43 tumble dryer.

The dispensing device—as described on page 16 line 26 to page 20 line 12 and shown in FIGS. 1, 3 and 4 of patent application PCT/EP01/11785 having a membrane thickness of 160 $\mu$m, a membrane pore size of 0.2 $\mu$m and membrane area of 1080 $mm^2$—was charged with 30 g of the sample and then attached to the internal side of the door of the tumble dryer and the 60 minutes "Cotton Extra Dry" drying cycle started. At the end of the cycle the fabrics were removed. Comparative evaluation with tumble dryer sheets was also made (for each cycle a single tumble dryer sheet was used).

Staining was evaluated by a panel of trained laboratory personnel in a standard Viewing Cabinet (D65 light, simulating typical northern hemisphere outdoor light). The panel assessed the staining of the aqueous compositions with a critical eye using different viewing angle and observing over a black background.

Unless otherwise indicated, each sample was assessed 3 times with the fabric being washed as described above between each assessment.

Staining was ranked according to the number of stains and the size/visibility of the stains on a scale of from 0 to 5 where 0 represented no staining and 5 represented severe staining.

The results are given in table 3 below.

TABLE 3

| Sample | TDS (1) | TDS (2) | 1 | A |
|---|---|---|---|---|
| Microfibre | 2.5 | 0 | 1 | 2 |
| Pongee | — | — | 1 | 3 |
| Jeans | 0 | 0 | 0 | 0.5 |

(1) Bounce - purchased in UK 2001
(2) Snuggle - purchased in US 2001

Delivery Evaluation

The following compositions were prepared according to the method described above.

TABLE 4

| Sample | 4 | 5 | 6 | 7 | 8 | D | E |
|---|---|---|---|---|---|---|---|
| Quat (1)* | 50 | 55 | 50 | 55 | 50 | 50 | 55 |
| DC 245 (2) | 25 | 20 | 0 | 0 | 0 | 0 | 0 |
| NP-35 (3) | 0 | 0 | 20 | 20 | 0 | 0 | 0 |
| Estol 1545 (4) | 0 | 0 | 0 | 0 | 20 | 0 | 0 |
| DPG (5) | 0 | 0 | 5 | 0 | 5 | 0 | 0 |
| DPnB (6) | 0 | 0 | 0 | 0 | 0 | 25 | 40 |
| Perfume | 5 | 5 | 5 | 5 | 5 | 5 | 5 |
| Water | 20 | 20 | 20 | 20 | 20 | 20 | 0 |

(1) Stepantex UL G80 (80%), hardened tallow (IV < 1) based TEA q quaternary ammonium material with 20% DPG solvent (ex Stepan)
(2) Volatile silicone oil, ex Dow Chemicals
(3) mineral oil, ex Emca
(4) ester oil, ex Uniqema
(5) ester oil, ex Uniqema
(5) dipropylene glycol (ex Dow Chemicals). This was present in addition to any DPG present in the raw material of the quaternary ammonium material.
(6) dipropyl glycol n-butyl ether
"*" denotes the level of raw material present.

Delivery evaluation was carried out as follows:

Approximately 30 g of the sample to be evaluated (table 4) was transferred to a dispensing device—described above. The device was then attached to the inside of the door of the Miele tumble dryer and the 60-minute "Cotton extra dry" heating cycle started.

For each sample, the amount of product delivered was measured at intervals during the heating cycle.

Delivery of between 1 and 2 grams of product during the 60 minute cycle was desirable. Below this amount, insufficient active ingredient would be delivered to the fabric. Significantly greater amounts than this would cause staining problems.

The amount in grams of each sample delivered is given in table 5.

TABLE 5

| Time/mins | 0 | 10 | 20 | 30 | 40 | 50 | 60 |
|---|---|---|---|---|---|---|---|
| Sample 5 | 0 | 0.04 | 0.11 | 0.28 | 0.5 | 0.76 | 1.06 |
| Sample 6 | 0 | 0.2 | 0.5 | 0.7 | 0.9 | 1.2 | 1.4 |
| Sample 7 | 0 | 0.05 | 0.14 | 0.38 | 0.68 | 0.92 | 1.04 |
| Sample 8 | 0 | 0.5 | 0.67 | 1.11 | 1.3 | 1.59 | 1.8 |
| Sample D | 0 | 0.26 | 2.88 | — | — | — | — |
| Sample E | 0 | 0.89 | 2 | — | — | — | — |

For samples D and E, delivery was ceased after approximately 20 minutes due to the excess of product delivered.

Staining Evaluation

Staining evaluation of the samples of table 4 was then carried out on the garments identified in table 2. Evaluation was made according to the method described in the example above.

The results are given in table 6.

TABLE 6

| Garment | Sample 5 | Sample 7 | Sample 8 | Sample D | Sample E |
|---|---|---|---|---|---|
| Single jersey | 0 | 0.5 | — | — | — |
| Sport trousers | 0 | 0 | — | — | — |
| Green shirt | 0.5 | 0 | — | — | — |
| Blue shirt | 0.5 | 0 | — | — | — |
| Fleece | 0.5 | 1 | — | — | — |
| Jeans trousers | 0 | 0.5 | — | — | — |
| Cotton monitor | 1 | 0 | 0.5 | 2.5 | 1.5 |
| Microfibre monitor | 0.5 | 0.5 | 1 | 3 | 2.5 |
| Pongee monitor | 0.5 | 0 | 1.5 | 4 | 3 |

"—" denotes not measured.

Perfume Evaluation

Perfume evaluation was also carried out using samples 4 to 8 and a standard commercially available tumble dryer sheet (Bounce, purchased in UK in 2001) over 10 wash and dry cycles.

A 1.5 kg load containing equal weight mixtures of cotton, polycotton, polyester, nylon, acrylic, microfibre monitors and pongee polyester monitors was washed as described above. The washed articles were spin dried and transferred to a Hotpoint Aquarius Tumble Dryer and then tumble dried for 60 minutes. This process was repeated 10 times, with the dispensing device remaining in position and without being recharged. After each cycle the articles were removed and assessed then washed and the cycle repeated until 10 cycles completed. For the sample containing the tumble dryer sheet, a new sheet was introduced before each drying cycle.

For each of the samples 4 to 8, perfume strength on fabrics after each drying cycle was significantly stronger than perfume strength on fabrics treated with the tumble dryer sheet.

Further Staining Evaluation

The following compositions were prepared by weighing the quat, oil, nonionic and optional solvent into a beaker and heating on a hot plate until molten (about 70° C.). Hot water (also about 70° C.) was then slowly dosed into the molten mixture with stirring. Perfume was added and stirring continued until a 'clear' liquid was produced. The liquid was left to cool either in a bottle or on a rotary blender.

TABLE 7

| Sample | 9 | 10 | 11 | 12 | 13 |
|---|---|---|---|---|---|
| Quat (1)* | 20 | 0 | 40 | 35 | 40 |
| Quat (2)* | 0 | 20 | 0 | 0 | 0 |
| Emnon SCR-PK (3) | 30 | 30 | 0 | 0 | 0 |
| Squalane 99% (4)* | 0 | 0 | 20 | 0 | 0 |
| Semtol 70/28 (5) | 0 | 0 | 0 | 15 | 0 |
| Sirius M40 (6) | 0 | 0 | 0 | 0 | 20 |
| Nonionic coco 11EO (ex Slovasol) | 20 | 20 | 5 | 10 | 5 |
| Dipropylene glycol | 5 | 5 | 0 | 0 | 0 |

TABLE 7-continued

| Sample | 9 | 10 | 11 | 12 | 13 |
|---|---|---|---|---|---|
| Water | 20 | 20 | 30 | 35 | 30 |
| Perfume | 5 | 5 | 5 | 5 | 5 |

(1) Stepantex ULG60 80% (DPG 20%) a hardened tallow TEA Quaternary ammonium material (IV < 1) (ex Stepan)
(2) Stepantex VL85G (85%) (15% DPG) a tallow TEA (IV < 1) quaternary ammonium material (ex Stepan)
(3) A sugar ester oil based on palm kernel (ex KAO)
(4) A natural oil (ex Aldrich)
(5) A white mineral oil (ex Goldschmidth)
(6) A white medicinal quality mineral oil (ex Silkolene)
"*" denotes the level of raw material present.

All above formulations produced microemulsions at the heating temperature of a tumble dryer.

Staining performance was evaluated according to the method described in the examples above. The results are given in table 8.

TABLE 8

| Sample | TDS (1) | 9 | 11 | 12 | 13 |
|---|---|---|---|---|---|
| black monitor | 0.5–1 | 0.5 | 0.5–1.0 | 0.5 | 0.5 |
| blue shirt | 0.5–1.0 | 1.0–1.5 | 0.5 | 0.5–1.0 | 0.0–0.5 |
| Pongee | 0.5–1.0 | 0 | 0 | 0.5 | 0 |
| green shirt | 0 | 0 | 0 | 0 | 0 |
| Microfibre (monitor) | 0.5 | 0.5–1.0 | 0–0.5 | 0.5 | 0 |
| sport trousers | 0 | 0.5 | 0 | 0 | 0 |
| Fleece | 0 | 0 | 0 | 0 | 0 |
| Jeans | 0 | 0 | 0 | 0 | 0 |
| Jersey | 0 | 0 | 0 | 0 | 0 |

(1) Bounce, purchased UK 2001.

TABLE B1

| Sample | A | 1 | 2 | 3 | 4 | 5 | 6 | 7 |
|---|---|---|---|---|---|---|---|---|
| Quat (1)* | 80 | 10 | 20 | 0 | 0 | 0 | 0 | 0 |
| Quat (2)* | 0 | 0 | 0 | 40 | 40 | 40 | 30 | 10 |
| Quaternised triethylene amine (3) | 0 | 0 | 0 | 0 | 0 | 0 | 5 | 0 |
| Polyelectrolyte (4) | 0 | 0 | 0 | 0 | 0 | 0 | 0 | 16 |
| Nonionic surfactant (5) | 0 | 40 | 40 | 10 | 0 | 15 | 10 | 0 |
| Nonionic surfactant (6) | 0 | 0 | 0 | 0 | 15 | 0 | 0 | 33 |
| DPG (7) | 10 | 0 | 0 | 0 | 0 | 0 | 15 | 5 |
| Glycol hydroxy pthalyl hydroxy pthalate (8) | 0 | 0 | 0 | 15 | 10 | 0 | 0 | 0 |
| Water | 5 | 45 | 35 | 30 | 30 | 40 | 40 | 31 |
| Perfume | 5 | 5 | 5 | 5 | 5 | 5 | 5 | 5 |

(1) Stepantex VL85G (85%), tallow (IV~35) based TEA quaternary ammonium material with 15% DPG solvent (ex Stepan)
(2) Stepantex UL G60 80% (DPG 20%), hardened tallow (IV < 1) based TEA quaternary ammonium material with 20% DPG solvent (ex Stepan)
(3) TEA (ex Aldrich) fully quaternised with di-methyl sulphate
(4) Catiofast CS (30% solution), ex BASF
(5) Genapol C200 (coco alcohol 20EO) ex Clariant
(6) Slovasol 2411, (coco alcohol 11EO) ex Sloveca
(7) dipropylene glycol (ex Dow Chemicals). This was present in addition to any DPG present in the raw material of the quaternary ammonium material.
(8) Glycol HPHP, ex Eastham
For materials in table marked "*", the amount denotes the level of raw material present.

The viscosity of the samples was measured at a shear rate of 106 $s^{-1}$ using a Haake Rotoviscometer RV20 cup and bob NV1 at both ambient temperature and at the heating temperature of the tumble dryer. The results are given in table B2.

TABLE B2

| Temp/ ° C. | 25 | 30 | 32 | 34 | 36 | 38 | 40 | 42 | 44 | 46 | 48 | 50 | 53 | 56 | 58 | 60 | 62 |
|---|---|---|---|---|---|---|---|---|---|---|---|---|---|---|---|---|---|
| A | 1067 | 1040 | 850 | 670 | 510 | 350 | 260 | 190 | 160 | 140 | 120 | 110 | 89 | 77 | 70 | 65 | 65 |
| 2 | S | S | S | S | S | 780 | 595 | 231 | 211 | 190 | 173 | 164 | 150 | 133 | 128 | 120 | 105 |

"S" denotes that the composition was solid.

An Alternative Composition B is Defined as a Heat Activated Fabric Treatment Composition Comprising (a) from 3 to 75 wt % of one or more fabric treatment active ingredients;

(b) from 5 to 50 wt % of a nonionic surfactant; and (c) from 10 to 50 wt % of water.

Examples of this kind of composition are as follows: The samples in table B1 were prepared as follows:

The quat, nonionic and optional solvent were weighed in a beaker and heated on a hot plate until molten (about 70° C.). The molten mixture was then added with stirring to hot water (also about 70° C.) to which optional components such as a polyelectrolyte or salt had already been added. To this mixture, perfume was added and stirring continued until a 'clear' liquid was produced. The liquid was bottled and left to cool either in the bottle or on a rotary blender.

Delivery Evaluation

Delivery evaluation was carried out as follows:

Approximately 30 g of the sample to be evaluated (table B1) was transferred to a dispensing device—as described on page 16 line 26 to page 20 line 12 and shown in FIGS. 1, 3 and 4 of patent application PCT/EP01/11785 having a membrane thickness of 160 $\mu$m, a membrane pore size of 0.2 $\mu$m and membrane area of 1080 $mm^2$. The device was then attached to the inside of the door of a Miele Novotronic T43 tumble dryer and a 60 minute "Cotton Extra Dry" heating cycle started.

For each sample, the amount of product delivered was measured at intervals during the heating cycle. A comparison was also made with commercial tumble dryer sheets. The amount in grams of each sample delivered is given in table B3.

TABLE B3

| | Time/mins | | | | | | |
|---|---|---|---|---|---|---|---|
| | 0 | 10 | 20 | 30 | 40 | 50 | 60 |
| | Temperature/° C. | | | | | | |
| | 26 | 47 | 57 | 53 | 34 | 27 | 25 |
| Sample A | 0 | 0.03 | 0.22 | 0.55 | 0.77 | 0.97 | 1 |
| Sample 2 | 0 | 0.09 | 0.30 | 0.49 | 0.85 | 1.08 | 1.35 |
| Sample 6 | 0 | 0.05 | 0.25 | 0.42 | 0.70 | 0.95 | 1.25 |
| Bounce (1) | 0 | 0.2 | 0.43 | 0.67 | 0.8 | 0.97 | 0.93 |
| Snuggle (1) | 0 | 0.29 | 0.46 | 0.71 | 0.9 | 1 | 1.09 |

(1) commercial tumble dryer sheets purchased in US December 2001.

Staining Evaluation

Staining evaluation was then carried out on the fabrics identified in Table B4.

TABLE B4

| Garment | Fabric type | Colour | Texture |
|---|---|---|---|
| Single jersey | 100% acrylic | Multicolour | Knitted, thick |
| Sport trousers | 100% nylon | Buff | Woven with woven nylon lining, light |
| Green shirt | 100% cotton | Green | Woven, light |
| Blue shirt | 100% Polyester | Blue | Woven peach skin (brushed), heavy |
| Fleece | 52% polyester 40% cotton 8% lastane | | Towel looped knit, heavy |
| Jeans trousers | 100% cotton | Blue | Denim |
| Cotton monitor | 100% cotton | Black | Woven, light |
| Microfibre monitor | 100% polyester | Pearly | Woven, light |
| Pongee monitor | 100% polyester | Pink | Tuffata, lining type |

A 1.5 kg load was washed in a Miele Novotronic W820 washing machine using 80 g of un-perfumed Persil fabric washing powder at a 40° C. wash temperature. The fabrics were spin dried and then transferred to a Miele Novotronic T43 tumble dryer.

The dispensing device—as described above—was charged with 30 g of the sample and then attached to the internal side of the door of the tumble dryer and the 60 minute "Cotton Extra Dry" drying cycle started. At the end of the cycle the fabrics were removed.

Staining was evaluated by a panel of trained laboratory personnel in a standard Viewing Cabinet (D65 light, simulating typical northern hemisphere outdoor light). The panel assessed the staining of the aqueous compositions with a critical eye using different viewing angle and observing over a black background.

Unless otherwise indicated, each sample was assessed 3 times with the fabric being washed as described above between each assessment.

Staining was ranked according to the number of stains and the size/visibility of the stains on a scale of from 0 to 5 where 0 represented no staining and 5 represented severe staining.

The results are given in table B5 below.

TABLE B5

| Sample | A | 1 | 2 | 3* | 6 | 7* |
|---|---|---|---|---|---|---|
| Black monitor | 2.0–2.0 | 1.0–1.5 | 0.5–1.5 | 1.0–1.5 | 0.5–1.0 | 0 |
| Blue shirt | 2.0–2.0 | 0.0–1.5 | 0.0–1.5 | 2.0–2.5 | 0.5–1.5 | 0 |
| Pongee | 3.0–3.0 | 0.0–1.0 | 0.0–0.5 | 1.0–1.5 | 0.5–1.0 | 0 |
| Green shirt | 1.0–2.0 | 1.0–1.5 | 0.0–0.5 | 1.5–2.0 | 0–1.5 | 0 |

TABLE B5-continued

| Sample | A | 1 | 2 | 3* | 6 | 7* |
|---|---|---|---|---|---|---|
| Microfibre (monitor) | 1.5–2.0 | 0.5–1.0 | 0.0–1.0 | 2 | 0.0–2.0 | 0 |
| Sport trousers | 0.0–1.0 | 0 | 0 | 0 | 0 | 0 |
| Fleece | 0.0–0.50 | 0 | 0 | 0 | 0 | 0 |
| Jeans | 0.0–0.50 | 0 | 0 | 0 | 0 | 0 |
| Jersey | 0.0–0.50 | 0 | 0 | 0 | 0 | 0 |

*single test only

Further Staining Evaluation

Staining evaluation was also carried out using the samples (table B1) and a standard commercially available tumble dryer sheet (Bounce, purchased in UK in 2001) over 10 wash and dry cycles.

A 1.5 kg load containing equal weight mixtures of cotton, polycotton, polyester, nylon, acrylic, microfibre monitors and pongee polyester monitors was washed as described above. The washed articles were spin dried and transferred to a Hotpoint Aquarius Tumble Dryer and then tumble dried on medium setting for 60 minutes. This process was repeated 10 times, with the dispensing device remaining in position and without being recharged. After each cycle the articles were removed and assessed then washed and the cycle repeated until 10 cycles completed. For the sample containing the tumble dryer sheet, a new sheet was introduced before each drying cycle.

Staining was evaluated using the method described above. The average results over the ten cycle are given in table B5.

TABLE B5

| Sample | Bounce | 2 |
|---|---|---|
| Delivery/g | 0.42 | 1.15 |
| Static | 2.11 | 0.11 |
| Cling | 2.36 | 0.26 |
| Pongee | 1.13 | 0.06 |
| Microfibre | 1.83 | 0.39 |
| Average Stain | 1.48 | 0.23 |

The results demonstrate that the amount of the sample of the invention (and hence the amount of active ingredient) deposited on the fabrics was significantly greater than the amount deposited from the tumble dryer sheet. In spite of this, the staining evaluation results show a significantly lower level of staining on fabrics treated with sample 2 than on fabrics treated with the commercially available tumble dryer sheet.

What is claimed is:

1. A device for treating fabrics in a tumble dryer comprising: a reservoir for storing a fabric treatment composition and transfer means to expose fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle; wherein the transfer means is connected to the reservoir by a channel or duct and comprises two or more flow control members arranged in series, wherein the flow control characteristic of the members decreases across the series.

2. A device according to claim 1 wherein the transfer means comprises at least an inner flow control member and an outer flow control member.

3. A device according to claim 1 wherein the flow control characteristic decreases in the direction of flow.

4. A device for treating fabrics in a tumble dryer comprising: a reservoir for storing a fabric treatment composition and transfer means to expose fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle; wherein the transfer means is connected to the reservoir by a channel or duct and comprises at least an inner flow control member and an outer flow control member arranged in series, wherein the flow control characteristic of the inner flow control member is greater than that of the outer flow control member.

5. A device according to claim 4 wherein outer flow control member(s) have a greater rigidity than the inner flow control member(s).

6. A device according to claim 4 wherein the flow control members are spaced apart to define a gap therebetween.

7. A device according to claim 4 wherein the innermost flow control member is spaced apart from other flow control member.

8. A device according to claim 4 wherein the inner flow control member has a pore size in the range of 0.1–10 microns.

9. A device according to claim 8 wherein the inner flow control member has a pore size in the range of 0.1 to 0.3 microns.

10. A device according claim 9 wherein the inner flow control member has a pore size of 0.2 microns.

11. A device according to claim 4 wherein the outer flow control member comprises a sinter material.

12. A device according to claim 4 wherein the sinter material has a pore size of 35 micron.

13. A device according to claim 4 wherein the transfer means has an effective area of 500–5000 $mm^2$.

14. A device according to claim 4 wherein the transfer means has an effective area of 1080 $mm^2$.

15. A device according to claim 4 wherein the transfer means has an effective area of 1350 $mm^2$.

16. A device according to claim 4 wherein the transfer member has an effective area of 2400 $mm^2$.

17. A method of treating fabrics in a tumble dryer during multiple tumble drying cycles comprising attaching a device according to claim 1 to the inside of a tumble dryer door and carrying out a tumble drying process with fabrics inside the tumble dryer.

18. A method according to claim 17 in which the tumble drier is operated to achieve an elevated temperature of up to 100° C.

19. A method according to claim 18 in which the tumble drier is operated to achieve a temperature in the range 30° C. to 80° C.

20. A kit comprising a device according to claim 4 in combination with a fabric treatment composition optionally provided in a reservoir for use with said device.

21. A tumble dryer with a device according to claim 4 attached therein.

22. A reservoir for use with a device according to claim 4.

23. A reservoir according to claim 22 comprising a body formed from three or more substantially crescent or segment shaped faces.

* * * * *